US010023413B2

(12) United States Patent
Jakob

(10) Patent No.: US 10,023,413 B2
(45) Date of Patent: Jul. 17, 2018

(54) RAMP DEVICE

(71) Applicant: Joachim Jakob, Radolfzell (DE)

(72) Inventor: Joachim Jakob, Radolfzell (DE)

(73) Assignee: BOXPLAN GmbH & Co.KG (DE)

( * ) Notice: Subject to any disclaimer, the term of this patent is extended or adjusted under 35 U.S.C. 154(b) by 89 days.

(21) Appl. No.: 15/153,105

(22) Filed: May 12, 2016

(65) Prior Publication Data

US 2016/0332834 A1 Nov. 17, 2016

(30) Foreign Application Priority Data

May 13, 2015 (DE) ..... 20 2015 102 476 U

(51) Int. Cl.

| | |
|---|---|
| ***B23Q 3/06*** | (2006.01) |
| ***B65H 9/08*** | (2006.01) |
| ***B65H 5/14*** | (2006.01) |

(52) U.S. Cl.

CPC ..... *B65H 9/08* (2013.01); *B65H 5/14* (2013.01); *B65H 2404/563* (2013.01); *B65H 2405/58* (2013.01); *B65H 2701/176* (2013.01)

(58) Field of Classification Search

CPC ... B25B 1/00; B23Q 3/00; B66F 7/243; B66F 11/00

See application file for complete search history.

(56) References Cited

U.S. PATENT DOCUMENTS

| | | | | |
|---|---|---|---|---|
| 1,976,702 A | | 10/1934 | Trott | |
| 3,439,848 A | | 4/1969 | Schwartzkopf | |
| 3,556,503 A | | 1/1971 | Van Moss, Jr. | |
| 3,596,677 A | | 8/1971 | Clark et al. | |
| 3,735,653 A | | 5/1973 | Powell | |
| 3,946,627 A | | 3/1976 | Hofmann | |
| 3,990,681 A | * | 11/1976 | McKeen, Sr. | B66F 3/35 254/88 |
| 4,261,237 A | | 4/1981 | Di Donato | |
| 4,300,421 A | | 11/1981 | Yano et al. | |
| 4,451,026 A | * | 5/1984 | Coope | B23Q 11/0875 269/24 |

(Continued)

FOREIGN PATENT DOCUMENTS

| | | |
|---|---|---|
| AT | 390753 B | 6/1990 |
| CN | 202293424 U | 7/2012 |

(Continued)

OTHER PUBLICATIONS

International Search Report for PCT/EP2011/003575, dated Nov. 22, 2011.

(Continued)

*Primary Examiner* — Lee D Wilson

(74) *Attorney, Agent, or Firm* — Womble Bond Dickinson (US) LLP

(57) ABSTRACT

In a ramp device (1) for the positioning of raw material sheets and punched pieces, the ramp device (1) generally comprises a holding block (2). the holding block (2) has a top surface (8), a bottom surface (9) and at least three side walls (10.1 to 10.4). A spring element (4) is formed on the top surface (8) of the holding block (2), and the spring element (4) can, at first, have a curved course above the top surface of the holding block, and then can arch down toward the bottom surface (9) of the holding block (2) after reaching a vertex point (13).

9 Claims, 2 Drawing Sheets

(56) References Cited

U.S. PATENT DOCUMENTS

Figure 1:
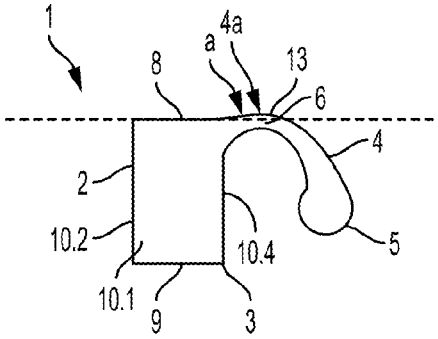

| | | | | |
|---|---|---|---|---|
| 5,228,554 | A | 7/1993 | Kuchta et al. | |
| 5,280,890 | A | 1/1994 | Wydra | |
| 5,337,639 | A | 8/1994 | Morrison | |
| 5,531,007 | A | 7/1996 | Labounty | |
| 5,546,839 | A | 8/1996 | Gardiner | |
| 5,906,363 | A | 5/1999 | Reis | |
| 6,199,236 | B1 * | 3/2001 | Mullins | B66F 7/243 14/69.5 |
| 7,350,255 | B2 * | 4/2008 | Zhang | B65G 69/30 14/69.5 |
| 8,220,779 | B2 * | 7/2012 | Schmuecker | B66F 5/02 254/134 |
| 8,783,148 | B2 | 7/2014 | Weibelt | |
| 8,899,393 | B2 | 12/2014 | Kraner | |
| 9,370,870 | B2 | 6/2016 | Jakob | |
| 2003/0160221 | A1 * | 8/2003 | Dunbar, Sr. | B66F 3/30 254/88 |
| 2007/0176341 | A1 | 8/2007 | Molitor | |
| 2008/0066595 | A1 | 3/2008 | Coursey et al. | |
| 2010/0107846 | A1 | 5/2010 | Lee et al. | |
| 2013/0068077 | A1 * | 3/2013 | Coursey | F16F 1/18 83/112 |
| 2013/0112053 | A1 | 5/2013 | Jakob | |
| 2015/0000485 | A1 | 1/2015 | Piro et al. | |
| 2016/0067876 | A1 | 3/2016 | Jakob | |
| 2016/0332834 | A1 * | 11/2016 | Jakob | B65H 5/14 |

FOREIGN PATENT DOCUMENTS

| | | | |
|---|---|---|---|
| CN | 203818653 | U | 9/2014 |
| DE | 2615919 | A1 | 10/1977 |
| DE | 102010036476 | A1 | 4/2011 |
| WO | WO 2012/019692 | | 2/2012 |

OTHER PUBLICATIONS

Written Opinion for PCT/EP2011/003575, dated Nov. 22, 2011, English translation.

International Preliminary Report on Patentability for PCT/EP2011/003575, dated Jan. 22, 2013.

http://mimas.physics.drexel.edu/Physics101/PHYS101LAB-03.pdf. Date Jun. 15, 2010 (archive.org). Example of springs of different rates coupled to a "block" commensurate in scope with claims 1 and 11.

* cited by examiner

RAMP DEVICE

CROSS REFERENCE TO RELATED APPLICATIONS

The present Patent Application claims priority to German Patent Application No. DE202015102476.2, filed May 13, 2015 by the inventor named in the present Application. The entire disclosure of the above-referenced patent application is incorporated herein by reference.

TECHNICAL FIELD

The present disclosure concerns a ramp device for accurate guidance of stamped parts or raw material sheets.

BACKGROUND

During the processing of paper-based products for packaging, such as those made of paper, cardboard, or carton, raw material sheets are typically guided across tools such as presses, punches or break-out tools. In this process, it is essential for the raw material sheets to be fed reliably and constantly the same and not to slip or in any way become skewed or buckled. Furthermore, it is of equal importance that products punched out, broken out or blank-separated from a raw material sheet are taken away reliably and quickly. An irregular feeding or takeaway due to possible skewing or jamming of the raw material sheets or the punched, broken-out, or blank-separated products leads to far-reaching problems in the processing. For example, if the raw material sheets are skewed at the openings of the stripping boards or blank separating tools, they will be wrongly punched, broken out, or blank separated; products not taken away result in blockage in the further processing sequence or faulty stack laying in the case of a blank separation. A jamming or skewing of the raw material sheets especially during the feeding through relatively large-area openings of the stripping boards or lower blank separation dies is therefore an enormous problem. Although the edges of the openings of the stripping boards and lower blank separation dies are rounded to avoid such problems, this measure is not enough to ensure a permanent and faultless production sequence, particularly for raw material sheets which are especially light or especially heavy. If such a problem should occur, costly time, costly material, and labor expense will be wasted, so that avoidable costs are incurred. Thus far, there has been no solution to the existing technical problem.

SUMMARY

A problem which the present disclosure proposed to solve is to create a device which prevents the aforementioned technical problems, especially the skewing or jamming of the various raw material sheets at the openings of the stripping boards or lower blank separation dies and supports the takeaway and further transport of the products.

The ramp device provides a more precise feeding or placing of raw material sheets in the tool or on the stripping board and on the other hand the takeaway of the products is supported.

According to embodiments of the invention, the ramp device is designed to form a ramp at one edge of an opening of a stripping board and/or a lower blank separation die of a tool so that a raw material sheet being fed at this place is not skewed or buckled, which can lead to a defective production or outage of the tool. In order to ensure this, several ramp devices generally are also placed at one edge, depending on the side of the opening of the stripping board or the lower blank separation die.

In some embodiments, the ramp device comprises a holding block. Typically, the holding block can be placed reversibly by hand into a ramp receptacle and a holding slot of a stripping board or a lower blank separation die. The holding block is typically square-shaped and has at least one rounding. Furthermore, holding slats can be arranged on the holding block to prevent a slippage or unwanted loosening of the holding block in and out from the ramp receptacle.

A spring element arranged at the holding block can stick out 0.3 to 1.0 mm above the edge of the stripping board or the lower blank separation die. The spring element can, at first, have a curved course above the top surface of the holding block and then arch down toward the bottom surface of the holding block after reaching a vertex point, in an essentially quarter-circle shape. This projecting piece can help facilitate the ramp function, and help prevent a faulty feeding of the raw material sheets.

In certain embodiments, the spring element may have a weakening at the vertex point, which determines the spring constant of the spring element. In different embodiments of the ramp device, this weakening can be varied, according to the type and material properties of the raw material sheet. With color coding, different spring constants or different ramp devices can be distinguished by the user. This can enable a user to quickly and easily select the proper ramp device for the corresponding raw material sheet.

In some embodiments, the holding block has at least one rounding. For example, several edges of the square-shaped holding block can have roundings or be rounded off. Furthermore, the holding block can have holding slats. This design further can make it easier for the user to move the holding block into a ramp receptacle and the holding slot of the stripping board or the lower blank separation die of a tool on the one hand, and help ensure a reliable positioning of the holding block in the ramp receptacle and the holding slot on the other hand.

When using the ramp device according to embodiments of the invention, the ramp device generally is inserted by hand into a ramp receptacle and a holding slot of a stripping board or a lower blank separation die. The spring element can stick out by its arch at the vertex point beyond the edge of the stripping board or the lower blank separation die so that a ramp is formed. The ramp so formed prevents a skewing, jamming or buckling of the raw material sheet being fed at the edge of the stripping board or the lower blank separation. Depending on the size of the individual opening, several ramp devices can be used.

If a raw material sheet is then fed and positioned, the resulting product will be pressed down by an upper break-out tool or upper blank separation die, while the spring element of the ramp device is loaded and the abutting bulge is pressed in the direction of the holding block. When a certain pressing depth of the product is reached by the upper break-out tool or upper blank separation die, the spring element rebounds to the position of rest. In this process, a downward directed push is transmitted to the product, via the abutting bulge at the free end of the spring element. This push transmitted to the product by the rebounding of the spring element promotes a smooth takeaway and further transport and helps prevent blockages or standstill due to products getting stuck.

FIGURE DESCRIPTION

Figure 2:
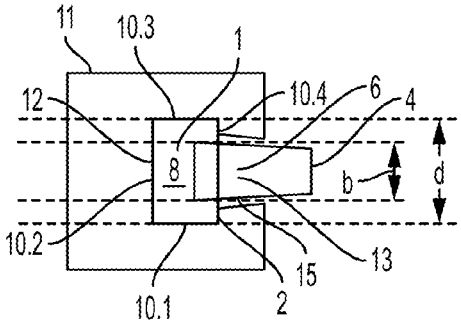
Figure 3:
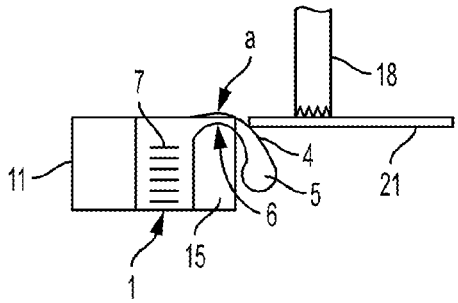
Figure 4:
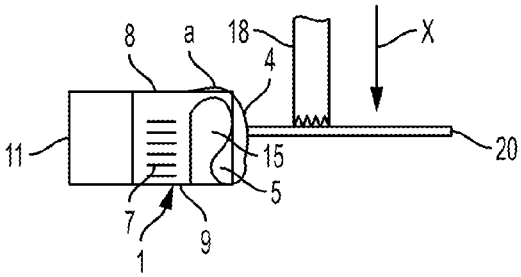
Figure 5:
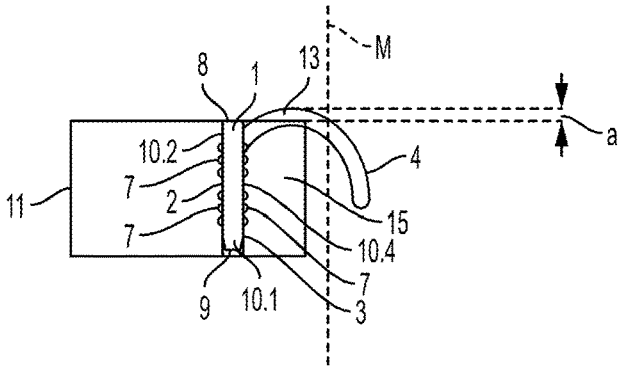
Figure 6:
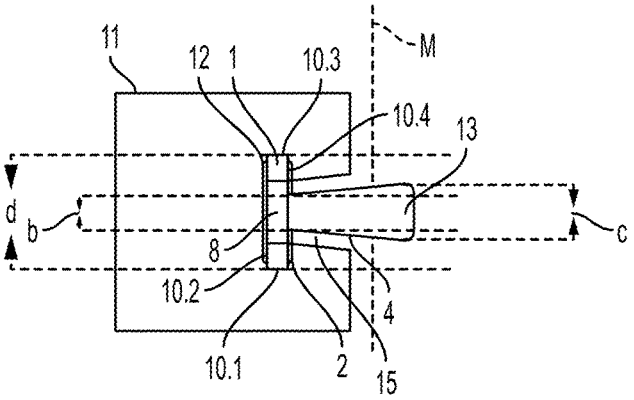
Figure 7:
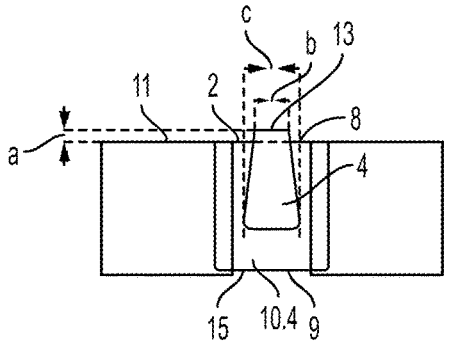

The disclosure will be explained below with the help of schematic drawings. The drawings show:

FIG. 1: a sectional side view of a ramp device according to one embodiment of the invention with a holding block and a spring element, FIG. 2: a top view of a ramp device according to one embodiment of the invention, which is inserted in a ramp receptacle and a holding slot of a tool, FIG. 3: a side view of a ramp device according to one embodiment of the invention in resting position in a ramp receptacle and a holding slot of a tool with product and a break-out tool, FIG. 4: a side view of a ramp device according to one embodiment of the invention in loading position in a ramp receptacle and a holding slot of a tool with product and a break-out tool, FIG. 5: a sectional side view of another ramp device according to one embodiment of the invention with a holding block and a spring element not having any weakness or abutting bulge, FIG. 6: a top view of a ramp device according to one embodiment of the invention, which is inserted in a ramp receptacle and a holding slot of a tool and comprises an increasingly protruding spring element, FIG. 7: a horizontal view of the side of a ramp device according to one embodiment of the invention where the spring element is situated, the ramp device is inserted in a ramp receptacle and a holding slot of a tool.

DESCRIPTION OF PREFERRED EMBODIMENTS

FIG. 1 shows a sectional side view of an embodiment of a typical ramp device 1. A holding block 2 is shown here. The holding block 2 in the sample embodiment shown here is essentially a cuboid.

The holding block 2 has a top surface 8, four side surfaces 10.1 to 10.4 and a bottom surface 9. The bottom surface 9 is arranged on the other side of the top surface 8 of the holding block 2, while the side walls 10.1 to 10.4 extend from the top surface 8 to the bottom surface 9.

Since the holding block 2 of the present disclosure is shown as essentially a cuboid, every two opposite side surfaces 10.1 to 10.4 generally have the same area. In turn, two of the side surfaces 10.2 and 10.4 have a larger area than the other two side surfaces 10.1 and 10.3. In the sample embodiment shown here, holding slats 7 arranged parallel to each other are formed on the other two side surfaces 10.1 and 10.3, which are shown for example in the partly see-through FIGS. 3 and 4. In another sample embodiment not shown, the holding slats 7 can also be arranged on the side surfaces 10.2 and 10.4.

The holding block 2 has at least one rounded edge 3.

Furthermore, in FIG. 1, a spring element 4 generally is formed as part of the top surface 8, while the spring element 4 at first has a curved course 4*a* above the top surface 8 of the holding block 2 and then arches down toward the bottom surface 9 of the holding block 2 after reaching a vertex point 13, in an essentially quarter-circle shape.

The course 4*a* as shown further can extend beyond the dimension of the side walls 10.1 to 10.4 from the bottom surface 9 to the top surface 8. In particular, it can extend beyond the top surface 8.

This spring element 4 generally has a weakness 6 at the vertex point 13, which can determine the spring constant of the spring element 4. Furthermore, an abutting bulge 5 is arranged in this sample embodiment at the free end of the spring element. The abutting bulge is meant to prevent the spring element 4 from possibly being pressed too much in the direction of the side wall 10.4 or taking too much time to return from this position to the starting position, as shown in FIG. 1. Depending on the nature of the weakening 6, it is also conceivable that the abutting bulge 5 may be less pronounced than in the sample embodiment shown, or not even pronounced at all.

The spring element 4 stands out from the top surface 8 where it is joined to the holding block by a preferred distance of about 0.3 to 1.0 mm above the holding block 2, depending on the type of configuration.

FIG. 2 shows a top view of a typical ramp device 1, which generally is situated in a holding slot 15 provided for this and a ramp receptacle 12 of a tool 11. A thickness d of the holding block 2 typically is greater than a width b of the spring element 4. The dimensions of the holding slot 15 and the ramp receptacle 12 are such that the ramp device 1 can be handily and reversibly inserted therein by a user by means of the holding block 2 and the holding slats 7 that can be optionally arranged on the side surfaces 10.1 to 10.4. In another conceivable embodiment, the ramp receptacle 12, the holding slot 15 and the holding block 2 can be configured such that a dovetail or prong-shaped connection is produced.

The spring element 4 can be free running and protrudes into an opening of the tool 11, and also can protrude at least partly into the holding slot 15 of the tool 11.

FIG. 3 shows a schematic cross section of a typical ramp device 1 which is arranged in a ramp receptacle 12 and a holding slot 15 of a tool 11. A raw material sheet can be fed accurately to the tool 11, before the resulting product 20 is moved from a break-out tool 18 in the direction x.

FIG. 4 shows a schematic cross section of a typical ramp device 1 which is arranged in a ramp receptacle 12 and a holding slot 15 of a tool 11. Furthermore the situation is shown in which a product 20 from a break-out tool 18 is pushed in the arrow direction x past the spring element 4 for takeaway and further transport.

FIG. 5 shows a sectional side view of a typical embodiment of a ramp device 1. The holding block 2 in the sample embodiment shown here is essentially a cuboid. As compared to the holding block 2 shown in FIG. 1, the side wall 10.1 and the opposite side wall 10.4 (not shown) is generally shown as being narrower. For example, the width of the side walls 10.1 and 10.4 in this sample embodiment can be about 1.8 mm. The distance between the top side 8 and bottom side 9 can be about 11.5 mm. Variations of these dimensions also can be provided.

The holding slats 7 are arranged on the opposite side walls 10.2 and 10.4. The bottom surface 9 of the holding block 2 is furthermore typically more narrow as compared to the top surface 8. This generally results in a slightly wedge-shaped configuration, which can make it easier to insert the holding block 2 into the ramp receptacle 13 and the holding slot 15.

The spring element 4 in this sample embodiment has no abutting bulge at its free end and likewise no weakening at the vertex point 13.

In this embodiment, the spring element 4 at first runs with a preferred height a of around 1.0 mm in a curve above the top surface 8 of the holding block 2 and then after reaching a vertex point 13 it arches downward in an essentially quarter-circle shape to the bottom surface (9) of the holding block (2). The spring element 4 protrudes into the holding slot 15 and an opening of a tool 11 such that it projects beyond the cutting line M, for example, by around 4.0 mm, though greater or lesser projections/distances also can be provided.

FIG. 6 shows a top view of a typical embodiment of a ramp device 1, which is arranged in a holding slot 15 and a ramp receptacle 12 of a tool 11. The holding slot 15 in this sample embodiment is shaped as a dovetail or prong and is adapted to the broadening shape of the spring element 4.

In this embodiment a configuration of the spring element 4 can be provided wherein it broadens from a width b of about 3.0 mm at the start on the holding block 2 to a width c of about 0.5 mm at the free end. With such a configuration, in addition to the ramp function, the takeaway and further transport of certain products can be substantially ensured in reliable manner. The broken line M marks the position at which the raw material sheet is cut, punched, or broken off.

FIG. 7 shows a horizontal view of the embodiment of a ramp device which is also shown in FIG. 6. The viewing direction is in horizontal line at the side wall 10.4 and shows the broadening configuration of the spring element 2. From the start of the spring element 2 at the top side 8 of the holding block 2 to the free end it can broaden by around 2.0 mm, for example, from around b 3.0 mm to around c 5.0 mm width.

The mode of operation is as follows:

The ramp device 1 is inserted with the holding block 2 in a ramp receptacle 12 and a holding slot 15 of the tool 11, so that the spring element 4 in the starting position stands above the edge of the tool so that a ramp is formed.

The raw material sheets can be fed by a feeding device, not otherwise depicted, to arrive at the defined punching or breaking position and slide partly or entirely across the ramp device 1. In the sample embodiment shown here, the raw material sheet is brought into the defined punching or breaking position. Buckling or skewing can be generally prevented by the ramp device. After the product 20 has been punched out, the rest of the raw material sheet is transported away across the ramp device, especially at first across the vertex point 13 of the spring element 4 and then across the top surface 8 of the holding block 2.

After this, the product 20 is broken off and/or blank-separated. Next, the product 20 is pressed in the arrow direction x, so that the spring element 4 is loaded and the free end is pressed in the direction of the side wall 10.4.

The pressed-down product 20 slides along the arc surface of the spring element 4 arranged at the side wall 10.4 until the product 20 has passed the abutting bulge 5 of the spring element 4. Thereupon, the product 20 is ejected downward in the direction of a floor, not otherwise described, by a rebounding of the spring element 4 into the starting position of FIG. 1. Lastly, the spring element 4 can again assume its starting position shown in FIG. 1 and again form the ramp at the edge of the tool 11.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

List of reference symbols

| | | | | |
|---|---|---|---|---|
| 1 | Ramp device | a | max. overhang of 4 beyond 2 | 67 |
| 2 | Holding block | b | Width | 68 |
| 3 | Rounded edge | d | Thickness | 69 |
| 4 | Spring element | x | Arrow direction x | 70 |
| 5 | Abutting bulge | c | Widtch | 71 |
| 6 | Weakening | M | Cutting line | 72 |
| 7 | Holding slats | 40 | | 73 |
| 8 | Top surface | 41 | | 74 |
| 9 | Bottom surface | 42 | | 75 |
| 10 | | 43 | | 76 |
| 11 | Tool | 44 | | 77 |
| 12 | Ramp receptacle | 45 | | 78 |
| 13 | Vertex point | 46 | | 79 |
| 14 | | 47 | | |
| 15 | Holding slot | 48 | | |
| 16 | | 49 | | |
| 17 | | 50 | | |
| 18 | Break-out tool | 51 | | |
| 19 | | 52 | | |
| 20 | Product | 53 | | |
| 21 | Raw material sheet | 54 | | |
| 10.1 | Side wall ($1^{st}$) | 55 | | |
| 10.2 | Side wall ($2^{nd}$) | 56 | | |
| 10.3 | Side wall ($3^{rd}$) | 57 | | |
| 10.4 | Side wall ($4^{th}$) | 58 | | |
| 26 | | 59 | | |
| 27 | | 60 | | |
| 28 | | 61 | | |
| 29 | | 62 | | |
| 30 | | 63 | | |
| 31 | | 64 | | |
| 32 | | 65 | | |
| 33 | | 66 | | |

What is claimed is:

1. A ramp device for the positioning of raw material sheets and/or punched pieces, wherein the ramp device comprises:

a holding block, wherein the holding block has a top surface, a bottom surface, and at least three side walls, and a spring element integrally formed with the holding block along the top surface thereof, wherein the spring element has a curved portion that is at least partially positioned above the top surface of the holding block and arches down toward the bottom surface of the holding block after reaching a vertex point, in an essentially quarter-circle shape, and wherein the spring element at least partially engages the raw material sheets and/or punch pieces positioned about the ramp device and at least partially prevents skewing, jamming, or buckling thereof.

2. The ramp device according to claim 1, wherein the holding block has holding slats arranged in parallel on one of the side walls.

3. The ramp device according to claim 1, wherein the spring element has a weakening at the vertex point.

4. A ramp device for the positioning of raw material sheets and/or punched pieces, comprising:

a holding block including a top surface, a bottom surface, and at least one side wall, the holding block is configured to be at least partially received within a holding slot of a tool; and a spring element integrally formed with the holding block, wherein the spring element comprises a curved portion that is at least partially positioned above the top surface of the holding block and arches down toward the bottom surface of the holding block after reaching a vertex point, in an essentially quarter-circle shape, wherein the spring element comprises an abutting bulge at an end of the spring element, wherein the spring element at least partially engages the raw material sheets and/or punch pieces positioned about the ramp device and at least partially prevents skewing, jamming, or buckling thereof.

5. The ramp device according to claim 1, wherein the spring element broadens by around a third from the holding block to a free end of the spring element.

6. The ramp device according to claim 1, wherein the holding block is at least partially received with in a holding slot of a tool, wherein a thickness of the holding block is slightly greater than a slot width of the holding slot of the tool, and wherein a ramp receptacle is formed next to the holding slot, which forms together with the holding slot a joint recess, in which the ramp device can be reversibly shoved.

7. The ramp device according to claim 6, wherein a width of the spring element is less than the slot width of the holding slot.

8. The ramp device according to claim 6, wherein the holding block has at least one rounded edge, suitable for the simple shoving of the holding block into the ramp receptacle and the holding slot.

9. A ramp device for the positioning a product of raw material sheets or punched pieces, comprising:

a holding block configured to be at least partially received within a holding slot of a ramp receptacle and including a top surface, a bottom surface, and at least one side wall, the at least one side wall having a plurality of slats defined therein that at least partially engage at least a portion of the ramp receptacle to substantially minimize slippage or loosening of the holding block within the holding slot; and a spring element integrally formed with the holding block and movable between an extended position and a retracted position when the spring element is at least partially engaged by the product positioned about the ramp device to substantially minimize skewing, jamming, or buckling thereof, the spring element comprising:

a curved portion at least partially positioned above the top surface of the holding block, and having a generally quarter-circle shape that extends down toward the bottom surface of the holding block after reaching a vertex point;

a weakened portion arranged at the vertex point that at least partially determines a spring constant of the spring element; and a bulge positioned at least partially along a free end of the spring element that facilitates return of the spring element to the extended position and/or controls movement of the spring element.

* * * * *